United States Patent [19]

Fujiwara et al.

[11] 4,339,330

[45] Jul. 13, 1982

[54] DESALTING METHOD OF FUEL OIL

[75] Inventors: Kiyoshi Fujiwara; Katsuaki Nagatomo; Fumio Shibata; Shoji Nomura; Shoji Yoshinaga, all of Kudamatsu, Japan

[73] Assignee: Hitachi, Ltd., Tokyo, Japan

[21] Appl. No.: 205,960

[22] PCT Filed: Dec. 14, 1979

[86] PCT No.: PCT/JP79/00317

§ 371 Date: Aug. 26, 1980

§ 102(e) Date: Aug. 26, 1980

[87] PCT Pub. No.: WO80/01388

PCT Pub. Date: Jul. 10, 1980

[30] Foreign Application Priority Data

Dec. 27, 1978 [JP] Japan ..... 53/159846

[51] Int. Cl.[3] ..... C10G 17/00; C10G 17/04; C10G 33/00; C10G 31/08

[52] U.S. Cl. ..... 208/251 R; 208/188

[58] Field of Search ..... 208/251 R, 188

[56] References Cited

U.S. PATENT DOCUMENTS

| | | | |
|---|---|---|---|
| 3,798,153 | 3/1974 | Arndt et al. | 208/251 R |
| 4,014,780 | 3/1977 | McCoy | 208/188 |
| 4,082,653 | 4/1978 | DeGraff | 208/251 R |

FOREIGN PATENT DOCUMENTS

| | | | |
|---|---|---|---|
| 6027442 | 8/1976 | Japan | 208/188 |
| 1562755 | 3/1980 | United Kingdom | 208/251 R |

*Primary Examiner*—Delbert E. Gantz
*Assistant Examiner*—Helane E. Maull
*Attorney, Agent, or Firm*—Craig and Antonelli

[57] ABSTRACT

The present invention provides a method for the desalting of fuel oil by mixing the fuel oil and clean water, thereby separating and eliminating sodium salts and potassium salts contained in the fuel oil, and the method comprises separating a heavy portion including salt-containing water from the fuel oil which is a light portion, this heavy portion separated from the fuel oil being separated into water and a residue by an evaporator, the water being reused as a washing water and the residue being burnt to use the generated heat as a heat source for the evaporator, whereby the residue is decreased in volume and solidified to be made easy in the handling.

8 Claims, 2 Drawing Figures

DESALTING METHOD OF FUEL OIL

TECHNICAL FIELD

The present invention relates to a desalting method of fuel oil to separate and eliminate sodium salts and potassium salts contained in the fuel oil.

BACKGROUND ART

In the desalting method of fuel oil, excepting a specific method, it would be conventional and known to separate water and sludge from the oil by making use of centrifugal force or static electricity, but the mixture of salt-containing water and sludge separated out of the oil have been discarded, and moreover there is no treating device suitable for the sludge comprising water, salts, heavy oil sludge and the like.

In the operation of desalting device, it is necessary to use clean washing water in an amount of about 1% based on the fuel oil, which water has never been reused in general. Accordingly, it was impossible to set up a plant of this kind in such a region as a desert region or the like where water is hardly available.

Further, as the separated heavy sludge containing both salts and water, there is no suitable treating device, and therefore any effective treating method has not yet been established.

A main object of the desalting is to eliminate sodium and potassium salts contained in fuel oil, which salts are mainly composed of sodium chloride and potassium chloride formed by the bond with chlorine and exist in the fuel oil either in the form of solution in a small amount of water contained therein or in the form of fine solid. It is known that these salts are soluble in water and therefore the elimination of sodium and potassium salts can be accomplished by washing the fuel oil with water to transfer the sodium and potassium salts into washing water and then separating the water from the fuel oil.

Referring to FIG. 1, a desalting apparatus of prior art is explained. Fuel oil 5 stored in a fuel oil tank 3 is led through a fuel oil pump 4 to a sludge separator 1, in which water and sludge contained in small amount in the fuel oil are separated as a heavy portion 6 from a desludge oil 7, taken out and then led to a waste water-treating equipment. Into the sludge-removed oil 7 feed from the heavy portion 6 is poured an emulsion breaker 10 from an emulsion breaker tank 8 through a pump 9, thereafter newly deionized clean water 13 is incorporated thereinto from a clean water tank 11 through a pump 12, and then the mixture is thoroughly mixed in a mixer 14 so as to dissolve salts contained in the sludge-removed oil 7 in water. The mixed liquid is led to a desaltor 2, in which a salt-containing water 15 is separated as a heavy portion from the oil, and then led to a waste water-treating equipment. The oil freed from the salt-containing water 5 contains only a very small quantity of salts and can be dealt with as a desalted fuel oil 16. In this manner, however, newly deionized clean water must be used and moreover the treatment of the separated heavy portion is left unsolved.

DISCLOSURE OF INVENTION

The present invention provides such a method that both the sodium and potassium salts-containing water contained in the fuel oil, and the newly added washing water which contains the sodium and potassium salts in consequence are separated from the oil by a separator, and thereafter refined by evaporation, whereby the recovered water can be used repeatedly as the washing water.

Further, according to the present invention, the salt and oil-containing heavy sludge separated from the fuel oil is burnt, whereby the generated heat can be recovered by the device for evaporation of water, and moreover the sludge troublesome in the handling can be solidified and decreased in volume so that the handling thereof is made easy.

In general, the fuel oil contains about 1000 ppm of water, in which the sodium and potassium salts are dissolved. Accordingly, when it is subjected to sedimentation to separate a light portion and a heavy portion the salts-containing water and the sludge are separated as the heavy portion from the oil. In the desalting of fuel oil, the separated oil is further washed with water newly added, followed by separation into a light portion and a heavy portion according to the sedimentation method, whereby the elimination of sodium and potassium salts slightly present therein can be performed. In general, the amount of water to be added in this stage is about 1% based on the oil. Thus, the sum of water contained in the oil as described above and water which has been added for the washing and then separated, reaches as large as 1.1% based on the fuel oil. Therefore, when the recovery percent of water from the separated waste water reaches about 91% or more and the recovered water is refined to decrease the sodium and potassium salts contained therein to 1000 ppm or less, the resulting water can be reused as the washing, so that there can be established a desalting device which requires no water supply from the outer system, in other words, there can be established a desalting device having a closed circuit in respect of water. In the refinement of water by the evaporation method, it is easy to decrease the sodium and potassium salts contained in the recovered water to 1000 ppm or less and it is also easy to increase the recovery of water to 91% or more by a proper selection of evaporators. The present invention is characterized by combination of the refining method of the separated water by evaporation, and the desalting device. Further the invention is characterized in that the refining of the separated water is carried out by evaporation and the evaporation residue is burnt to recover the heat for the evaporator, and moreover decrease in the volume, solidification and facilitation in the handling of the separated sludge can be accomplished because the sludge is taken out as the incineration residue.

BEST MODE FOR CARRYING OUT THE INVENTION

Figure 1:
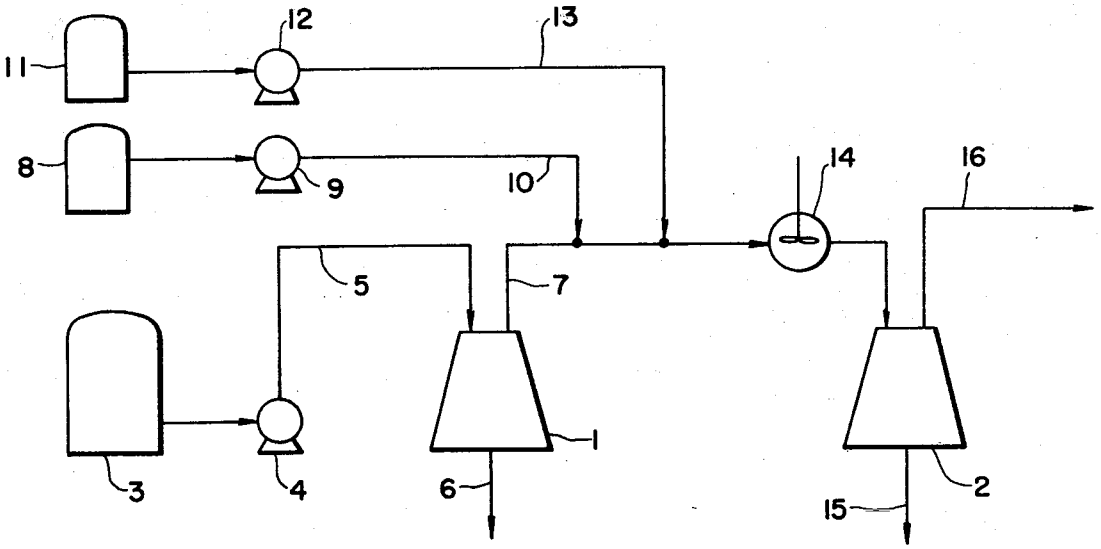
FIG. 1 systematically shows a device for the desalting of fuel oil in accordance with a prior art, and FIG. 2 systematically shows one embodiment of the desalting device for carrying out the method of the present invention.
Figure 2:
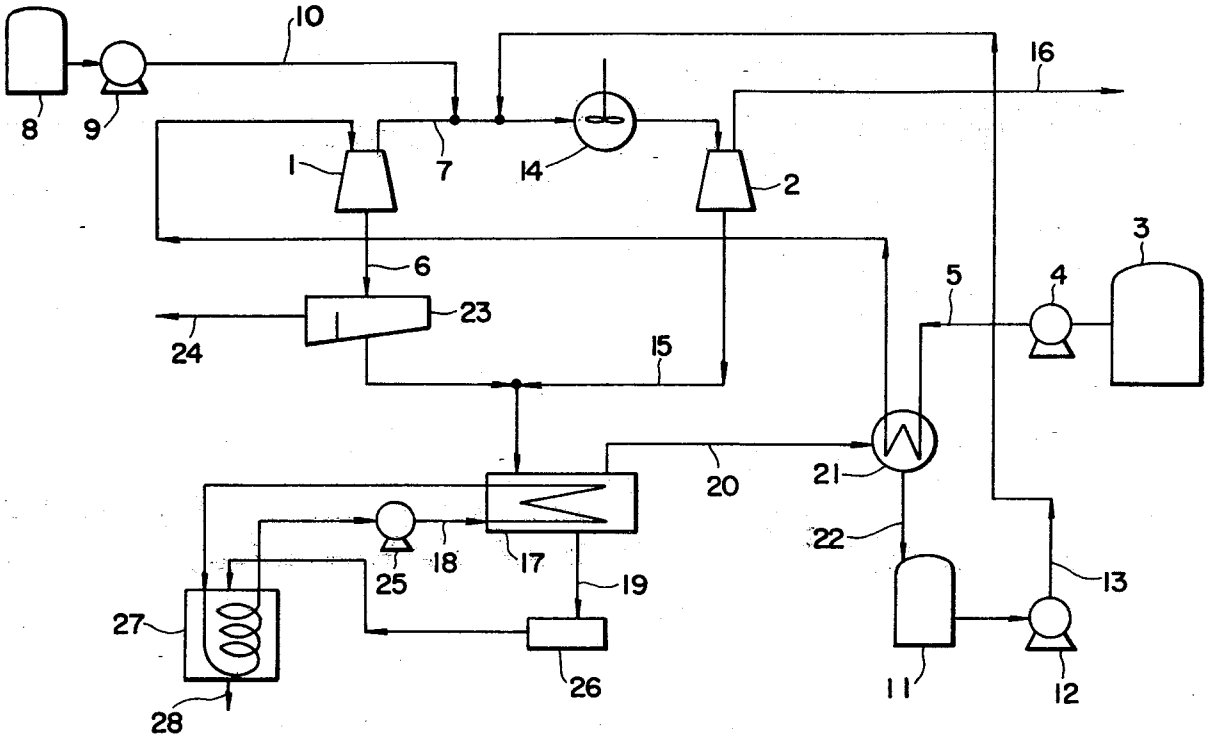

Referring to FIG. 2, one embodiment of the device for carrying out the present invention is illustrated as follows. In FIG. 2, the same portion as in FIG. 1 is marked with the same symbol as that. The heavy portion 6 separated through the sludge separator 1 is led to an oil separator 23 to recover an oil as a recovered oil 24, and then mixed with the salt-containing water 15 separated through the desaltor 2, and the mixture is supplied to an evaporator 17. In the evaporator 17, the mixture is heated by means of a heat medium 18, and a steam 20 evaporated is heat-exchanged with the fuel oil 5 in a heat exchanger 21, thereby recovering the heat, and then condensed to form a condensed water 22, which is stored in the clean water tank 11, and thereafter incorporated into the sludge-removed oil 7 as the clean water 13 through the clean water pump 12. On the other hand, a residue 19 freed from water through the evaporator 17 is led through a residue pump 26 to an incinerator 27, where the combustibles therein are burnt, so that the heat medium 18 to be cycled through a heat medium-cycling pump 25 is heated, and a combustion residue 28 decreased in volume is taken out from the lower part of the incinerator 27.

Although the above embodiment shows a case where the fuel oil is mixed with clean water after sludge has been removed from the fuel oil, and then subjected to desalting treatment, it is apparent by the above explanation that the present invention can be applied also in such a manner that the fuel oil is firstly mixed with clean water and then the sludge and the salt-containing water are separated from the oil.

EXAMPLE

Using as fuel oil an untreated crude oil, Arabian Light, stored in a tank, the desalting treatment was carried out in accordance with the method of the present invention, and the following results were obtained.

(1) Content of impurities in the crude fuel oil
Sodium: 5 ppm
Potassium: 0.4 ppm
Water: 1200 ppm (2) Content of impurities in the fuel oil at the outlet of sludge separator
Sodium: 0.9 ppm
Potassium: 0.07 ppm
Water: 100 ppm (3) Amount of the sludge taken out at the sludge separator: 50 Kg (4) Aids added before putting into the desalting device
Clean water: 10 Kg
Emulsion breaker: 0.02 Kg (5) Content of impurities in the fuel oil at the outlet of desalting device
Sodium: 0.4 ppm
Potassium: 0.01 ppm
Water: 90 ppm (6) Amount of the oil and salt-containing water taken out at the desalting device: 50 Kg (7) Amount of condensed water recovered at the heat exchanger: 11 Kg From the above results, it was found that the desalting method in accordance with the present invention can be carried out only with initially added water, and can rather produce surplus water.

As described above, the present invention provides a desalting method comprising combination of a device for the desalt of fuel oil with recovery and refinement of the separated water in an evaporation manner, by which method a small amount of water contained in the fuel oil can be recovered, and the recovered water is reusable for the desalting in a closed system so that the desalting device of fuel oil can be set up even in a region where water is hardly available, and moreover the sludge discharged from the desalting device can be used for the recovery of heat by incineration, and made easy in the handling because of the combustion residue being decreased in the volume and solidified.

We claim:

1. A desalting method of a fuel oil comprising mixing the fuel oil and clean water and separating and removing a heavy portion including salt-containing water from said fuel oil which is a light portion, putting the heavy portion including the salt-containing water which has been separated from the fuel oil into an evaporator to separate water and a residue from each other, evaporating and recovering water, and then reusing the water recovered by the evaporation as the clean water.

2. The desalting method of fuel oil according to claim 1, wherein a heat transfer medium is used in the evaporator to evaporate water, and wherein residue separated from the water is burnt in an incinerator, the heat from the burning of the residue used for heating the heat transfer medium used in the evaporator for evaporating water.

3. The desalting method of fuel oil according to claim 1 or 2, wherein the heavy portion and the fuel oil are separated by sedimentation.

4. The desalting method of fuel oil according to claim 1 or 2, wherein the fuel oil is separated from sludge contained in said fuel oil prior to mixing the fuel oil and clean water, and the sludge and the heavy portion which have been separated from the fuel oil are put into said evaporator to separate water and a residue from each other.

5. The desalting method of fuel oil according to claim 1 or 2, wherein the fuel oil contains sludge, and the fuel oil containing sludge is mixed with the clean water, sludge and said heavy portion are separated and removed from said fuel oil, and the separated and removed sludge and heavy portion are put into said evaporator to separate water and a residue from each other.

6. A method of recovering and reusing water from the desalting of fuel oil, comprising the steps of separating and removing a heavy portion including salt-containing water from the desalted fuel oil which is a light portion, putting the heavy portion including the salt-containing water which has been separated from the desalted fuel oil into an evaporator to separate water and a residue from each other, evaporating and recovering water, and then reusing the water recovered by the evaporation to desalt further fuel oil.

7. The method of recovering and reusing water from the desalting of fuel oil according to claim 6, wherein a heat transfer medium is used in the evaporator to evaporate water, and wherein the residue separated from the water is burnt in an incinerator, the heat from the burning of the residue being used for heating the heat transfer medium used in the evaporator for evaporating water.

8. The method of recovering and reusing water from the desalting of fuel oil according to claim 6 or 7, wherein the heavy portion and the fuel oil are separated by sedimentation.

* * * * *